US007264887B2

(12) United States Patent
Khan et al.

(10) Patent No.: US 7,264,887 B2
(45) Date of Patent: Sep. 4, 2007

(54) MCRALY BOND COATING AND METHOD OF DEPOSITING SAID MCRALY BOND COATING

(75) Inventors: Abdus Suttar Khan, Ennetbaden (CH); Mohamed Nazmy, Fislisbach (CH)

(73) Assignee: Alstom Technology Ltd., Baden (CH)

( * ) Notice: Subject to any disclaimer, the term of this patent is extended or adjusted under 35 U.S.C. 154(b) by 2 days.

(21) Appl. No.: 10/887,531

(22) Filed: Jul. 8, 2004

(65) Prior Publication Data

US 2005/0003227 A1 Jan. 6, 2005

Related U.S. Application Data

(63) Continuation of application No. PCT/IB02/05488, filed on Dec. 18, 2002.

(30) Foreign Application Priority Data

Jan. 10, 2002 (EP) ..... 02000559

(51) Int. Cl.
*B32B 15/04* (2006.01)

(52) U.S. Cl. ..... 428/632; 416/241 R; 428/650; 428/670; 428/679; 428/612

(58) Field of Classification Search ..... 428/336, 428/632, 633, 610, 650, 655, 640, 679, 680, 428/697, 699, 701, 702, 670, 612; 416/241 R
See application file for complete search history.

(56) References Cited

U.S. PATENT DOCUMENTS 3,528,861 A 9/1970 Elam et al. ..... 148/11.5
3,676,085 A 7/1972 Evans et al. ..... 29/194
3,754,903 A 8/1973 Goward et al. ..... 75/171
3,918,139 A 11/1975 Felten ..... 29/194
4,055,705 A 10/1977 Stecura et al. ..... 428/633
4,095,003 A 6/1978 Weatherly et al. ..... 427/34
4,152,223 A 5/1979 Wallace et al. ..... 204/37 R
4,248,940 A 2/1981 Goward et al. ..... 428/633
4,291,448 A 9/1981 Cretella et al. ..... 29/156.8 B
4,313,760 A 2/1982 Dardi et al. ..... 106/1.12
4,321,311 A 3/1982 Strangman ..... 428/623

(Continued)

FOREIGN PATENT DOCUMENTS

DE 19842417 3/2000

(Continued)

*Primary Examiner*—Jennifer McNeil
*Assistant Examiner*—Aaron Austin
(74) *Attorney, Agent, or Firm*—Darby & Darby

(57) ABSTRACT

A method of depositing a bond coating to a surface of an article includes the steps of depositing an inner layer of the bond coating consisting of β-NiAl comprising Fe, Ga, Mo, B, Hf or Zr or γ/β-MCrAlY comprising Fe, Ga, Mo, B, Hf or Zr or γ/γ'- or γ-MCrAlY, and depositing an outer layer of the bond coating, which is more coarse the in the inner layer, consisting of β-NiAl comprising Fe, Ga, Mo, B, Hf or Zr or γ/β-MCrAlY comprising Fe, Ga, Mo, B, Hf or Zr or γ/γ'- or γ-MCrAlY, wherein said elements Fe, Ga, Mo, B, Hf or Zr above mentioned are present individually or in combination. The coating also includes a noble metal selected from the group consisting of platinum, palladium and rhodium in the inner and outer layer or as a separate layer.

15 Claims, 2 Drawing Sheets

U.S. PATENT DOCUMENTS

| | | | | | |
|---|---|---|---|---|---|
| 4,346,137 | A | | 8/1982 | Hecht | 428/215 |
| 4,419,416 | A | | 12/1983 | Gupta et al. | 428/656 |
| RE32,121 | E | | 4/1986 | Gupta et al. | 428/656 |
| 4,585,481 | A | | 4/1986 | Gupta et al. | 106/14.05 |
| 4,676,994 | A | | 6/1987 | Demaray | 427/42 |
| 4,714,624 | A | | 12/1987 | Naik | 427/34 |
| 4,743,514 | A | | 5/1988 | Strangman et al. | 428/678 |
| 4,880,614 | A | | 11/1989 | Strangman et al. | 428/623 |
| 4,973,445 | A | | 11/1990 | Singheiser | 420/443 |
| 5,403,669 | A | | 4/1995 | Gupta et al. | 428/550 |
| 5,511,948 | A | | 4/1996 | Suzuki et al. | 416/191 |
| 5,514,482 | A | | 5/1996 | Strangman | 428/623 |
| 5,579,534 | A | * | 11/1996 | Itoh et al. | 428/547 |
| 5,645,893 | A | | 7/1997 | Rickerby et al. | 427/405 |
| 5,759,301 | A | | 6/1998 | Konter et al. | 148/404 |
| 5,817,371 | A | * | 10/1998 | Gupta et al. | 427/454 |
| 5,843,585 | A | | 12/1998 | Alperine et al. | 428/623 |
| 5,866,271 | A | | 2/1999 | Stueber et al. | 428/545 |
| 5,894,053 | A | | 4/1999 | Fried | 428/548 |
| 5,900,326 | A | * | 5/1999 | Bornstein et al. | 428/632 |
| 5,942,337 | A | | 8/1999 | Rickerby et al. | 428/623 |
| 6,020,075 | A | * | 2/2000 | Gupta et al. | 428/612 |
| 6,066,405 | A | | 5/2000 | Schaeffer | 428/547 |
| 6,123,997 | A | | 9/2000 | Schaeffer et al. | 427/383.7 |
| 6,153,313 | A | * | 11/2000 | Rigney et al. | 428/632 |
| 6,165,628 | A | * | 12/2000 | Borom et al. | 428/610 |
| 6,242,050 | B1 | | 6/2001 | Ritter et al. | 427/454 |
| 6,264,766 | B1 | | 7/2001 | Ritter et al. | 148/525 |
| 6,306,515 | B1 | | 10/2001 | Goedjen et al. | 428/469 |
| 6,464,128 | B1 | | 10/2002 | Messelling et al. | 228/119 |
| 6,607,789 | B1 | | 8/2003 | Rigney et al. | 427/454 |
| 6,610,419 | B1 | | 8/2003 | Stamm | 428/632 |
| 2003/0118863 | A1 | * | 6/2003 | Darolia et al. | 428/650 |
| 2003/0157363 | A1 | * | 8/2003 | Rigney et al. | 428/680 |

FOREIGN PATENT DOCUMENTS

| | | | |
|---|---|---|---|
| EP | 0366924 | | 5/1990 |
| EP | 0718419 | | 6/1996 |
| EP | 0792948 | | 9/1997 |
| EP | 0979881 | | 2/2000 |
| EP | 985745 | A1 * | 3/2000 |
| EP | 1111091 | | 6/2001 |
| EP | 1254967 | | 11/2002 |
| EP | 1260608 | A1 * | 11/2002 |
| WO | 9943861 | | 9/1999 |
| WO | 9955527 | | 11/1999 |

* cited by examiner

MCRALY BOND COATING AND METHOD OF DEPOSITING SAID MCRALY BOND COATING

This application is a continuation of International Patent Application No. PCT/IB02/05488, having an international filing date of Dec. 18, 2002, which published as WO 03/057944, and which claims priority to European Patent Application No. EP 02000559.1, filed on Jan. 10, 2002. The entire disclosure of both applications is incorporated by reference herein.

The present invention relates to a layered bond coating deposited on an article and to a method of depositing the bond coating.

BACKGROUND

Components designed for the use in the area of high temperature, e.g. blades or vanes of a gas turbine, are usually coated with environmentally resistant coatings. The coating protects the base material against corrosion and oxidation due to the thermal effect of the hot environment and consists of an alloy mostly using the elements Al and Cr. Most turbine components are coated for the protection from oxidation and/or corrosion with, for example, a MCrAlY coating (base coat) and some are also coated with a Thermal Barrier Coating (TBC) for thermal insulation. MCrAlY protective overlay coatings are widely known in the prior art. They are a family of high temperature coatings, wherein M is selected from one or a combination of iron, nickel and cobalt. As an example, U.S. Pat. No. 3,528,861 or U.S. Pat. No. 4,585,481 disclose such kind of oxidation resistant coatings. U.S. Pat. No. 4,152,223, as well discloses such method of coating and the coating itself. Besides the γ/β-MCrAlY-coating, there is another class of overlay MCrAlY coatings which are based on a γ/γ'-gamma/gamma prime-structure, such as is disclosed in U.S. Pat. No. 4,973,445. The advantages of γ/γ'-coatings is that they have a negligible thermal expansion mismatch with alloy of the underlying turbine article. For higher thermal fatigue resistance the γ/γ'-coating are more convenient compared to the γ/β-type of MCrAlY-coatings. A higher thermal fatigue resistance in coatings is most desirable since failure of the most turbine blades and vanes at elevated temperature is typically thermal fatigue driven.

Among γ/γ'-coatings and γ/β-coatings, the field of γ/β-coatings have been an active area of research and a series of patents has been issued. E.g. a NiCrAlY coating is described in U.S. Pat. No. 3,754,903 and a CoCrAlY coating in U.S. Pat. No. 3,676,058. U.S. Pat. No. 4,346,137 discloses an improved high temperature fatigue resistance NiCoCrAlY coating. U.S. Pat. No. 4,419,416, U.S. Pat. No. 4,585,481, U.S. Reissue Pat. No. RE-32,121 and U.S. Pat. No. 4,743,514 describe MCrAlY coatings containing Si and Hf. U.S. Pat. No. 4,313,760 discloses a superalloy coating composition with good oxidation, corrosion and fatigue resistance.

Furthermore, in the state of the art Thermal Barrier Coatings (TBC) are known from different patents. U.S. Pat. No. 4,055,705, U.S. Pat. No. 4,248,940, U.S. Pat. No. 4,321,311 or U.S. Pat. No. 4,676,994 disclose a TBC-coating for the use in the turbine blades and vanes. The ceramics used are yttria stabilized zirconia and applied by plasma spray (U.S. Pat. Nos. 4,055,705 and 4,248,940) or by electron beam process (U.S. Pat. Nos. 4,321,311 and 4,676,994) on top of the MCrAlY bond coat.

Attempts have made in the literature in improving the adhesion of TBC by surface modification of the underlying bond coats. Briefly, U.S. Pat. No. 5,894,053 formed a rough surface on bond coat by applying a particulate metallic powders prior to ceramic thermal barrier coatings. The essential content of the patent is a process of forming a roughened surface by applying particulate materials on the bond coat using binder, and soldering powder. The disadvantages of the process could be the microstructural incompatibilities of the soldering materials with the coatings and thereby weakening the TBC interface at the Thermal Grown Oxide (TGO). In U.S. Pat. No. 4,095,003 a rough bond coat surface is formed by spraying a second layer of the bond coat using coarser plasma spray powders. In details the goal of U.S. Pat. No. 4,095,003 was to first provide a sealing layer to protect the substrate by a bond coat and then form a rough surface upon the bond coat by plasma spraying with coarse particles. Not considered was the formation of higher amount of transient oxides on the rough surface of MCrAlY coatings. These oxides are NiO and $Cr_2O_3$ including mixed oxides or spinel are formed during early oxidation. This observation is relevant to the TGO formed on the bond coat. The transient oxides formed are in contact with the TBC thusly weakening the interface.

Similar concepts of surface roughening were also used by U.S. Pat. No. 5,403,669; U.S. Pat. No. 5,579,534. In U.S. Pat. No. 5,403,669 the substrate is coated with a bond coat, then a rough bond coat is formed by plasma spraying then over aluminising the bond coat which is followed by TBC deposition. In U.S. Pat. No. 5,866,271 formed the rough surface on the superalloy substrate itself by either grit blasting, water jet blasting, plasma etching or atmospheric plasma spraying followed by aluminising or Pt aluminising of the surface prior to TBC application. In U.S. Pat. No. 6,242,050 formed the rough surface on the bond coat by application of powder using aluminum-silicon slurry. In yet in another patent U.S. Pat. No. 6,264,766 produced the rough surface by interwoven wires followed by metallic slurry coatings on the interwoven wires.

The rough surface tends to form transient oxides easily during early oxidation. The transient oxides are NiO and $Cr_2O_3$ and mixed oxides, i.e., spinel. Similarly, the rough surface formed by plasma spraying with coarse particles tends to form transient oxides during early oxidation. These transient oxides constituting the upper surface of the TGO is a weak point in the adhesion of TBC at the interface. The preferred oxide in the TGO is the alumina. A rough surface that does not form transient oxides or removal of transient oxides prior to TBC deposition will be a benefit in TBC adhesion. But, the rough surface formed by spraying of coarse particles tends to nucleate a higher amount of transient NiO and $Cr_2O_3$ in the scale.

Formation of alumina scale on the bond coat by pre-oxidation is known in the literature. In U.S. Pat. No. 6,123,997 preoxidized bond coats under defined temperatures and oxygen partial pressures to form alumina wherein the bond coat may also contain doped Pt or other noble metals. In yet another patent, U.S. Pat. No. 6,066,405, bond coats are used having an integrated bond coat with aluminum from 18 to 24 percent and integrated platinum content from 18 to 45 percent. U.S. Pat. No. 3,918,139 discloses a MCrAlY coating which comprises 3 to 12% of a noble metal selected from the group consisting of platinum or rhodium. The presence of platinum or rhodium greatly improves sulfidation resistance, and known to provide benefits to oxide adherence as well as reduce the propensity of forming transient oxides.

Furthermore, German Patent Document DE-A1-19842417 discloses a MCrAlY coating onto which a layer of pure platinum of 1 to 20 micrometer is deposited before it is coated with a ceramic coating. The platinum is applied for reasons of increased adherence of the Thermal Barrier Coating and the formation of a thin layer of aluminum oxide.

In addition, U.S. Pat. No. 5,942,337 discloses a multi-layered Thermal Barrier Coating for a superalloy article comprises a platinum enriched superalloy, a MCrAlY bond coating on the platinum enriched superalloy layer, a platinum enriched MCrAlY layer on the MCrAlY bond coating, a platinum aluminide coating on the platinum enriched MCrAlY layer, an oxide layer on the platinum aluminide coating and a ceramic Thermal Barrier Coating on the oxide layer.

SUMMARY OF THE INVENTION

An object of the present invention is to provide a method of depositing a thinner MCrAlY bond coating uniformly over the surface of the blades and vanes. The bond coat should be ductile. A further or alternate object of the present invention is to provide a bond coating with an enhanced surface roughness for an increased TBC adhesion. The roughened layer deposited for TBC adhesion should form continuous alumina scale devoid of any NiO or $Cr_2O_3$ i.e. mixed oxides. Yet a further or alternate object of the present invention is to provide a layer on top of the coating which forms an alumina TGO readily in the engine or by prior heat treatment. In addition, a coating process should be used that allows deposition of thin coatings. The attempt here is to reduce the effects of the coefficient thermal expansion (CTE) mismatch and bond coat properties effects i.e. modulas etc. on adhesion.

The present invention provides an article (1) coated on the surface with an inner layer (2) of a high temperature metallic coating consisting of β-NiAl comprising one or a combination of Fe, Ga, Mo, B, Hf or Zr or γ/β-MCrAlY comprising one or a combination of Fe, Ga, Mo, B, Hf or Zr or γ/γ'- or γ-MCrAlY, and the coating comprising a platinum type metal, the platinum type metal material selected from the group consisting of platinum (Pt), palladium (Pd) and rhodium (Rh) and coated with an outer layer (3) of a high temperature metallic coating consisting of β-NiAl comprising one or a combination of Fe, Ga, Mo, B, Hf or Zr or γ/β-MCrAlY comprising one or a combination of Fe, Ga, Mo, B, Hf or Zr or γ/γ'- or γ-MCrAlY, and a platinum type metal, the platinum type metal material selected from the group consisting of platinum (Pt), palladium (Pd) and rhodium (Rh), the outer layer (3) being deposited on top of the inner layer (2) and being more coarse than the inner layer (2) and coated with a Thermal Barrier Coating (4).

The present invention also provides an article (1) coated on the surface with an inner layer (2) of a high temperature metallic coating consisting of β-NiAl comprising one or a combination of Fe, Ga, Mo, B, Hf or Zr or γ/γ-MCrAlY comprising one or a combination of Fe, Ga, Mo, B, Hf or Zr or γ/γ'- or γ-MCrAlY, and coated with an outer layer (3) of a high temperature metallic coating consisting of β-NiAl comprising one or a combination of Fe, Ga, Mo, B, Hf or Zr or γ/β-MCrAlY comprising one or a combination of Fe, Ga, Mo, B, Hf or Zr or γ/γ'- or γ-MCrAlY, the outer layer (3) being deposited on top of the inner layer (2) and being more coarse than the inner layer (2) and coated with at least a layer (5) of a platinum type metal, the platinum type metal material selected from the group consisting of platinum (Pt), palladium (Pd) and rhodium (Rh), the layer (5) of a platinum type metal is deposited on to the surface of the article (1), between the inner and the outer layer (2, 3) or on top of the outer layer (2), and coated with a Thermal Barrier Coating (4).

Furthermore, the present invention provides a method of depositing a bond coating to a surface of an article (1), wherein before a Thermal Barrier Coating (TBC) is applied, comprising the steps of:

depositing an inner layer (2) of the bond coating consisting of β-NiAl comprising one or a combination of Fe, Ga, Mo, B, Hf or Zr or γ/β-MCrAlY comprising one or a combination of Fe, Ga, Mo, B, Hf or Zr or γ/γ'- or γ-MCrAlY, and the coating comprising a platinum type metal, the platinum type metal material selected from the group consisting of platinum (Pt), palladium (Pd) and rhodium (Rh) to the surface of the article using powder in the size range up to 65 μm and depositing by plasma spraying an outer layer (3) of the bond coating, which is more coarse than the in the inner layer (2), consisting of β-NiAl comprising one or a combination of Fe, Ga, Mo, B, Hf or Zr or γ/β-MCrAlY comprising one or a combination of Fe, Ga, Mo, B, Hf or Zr or γ/γ'- or γ-MCrAlY, and the coating comprising a platinum type metal, the platinum type metal material selected from the group consisting of platinum (Pt), palladium (Pd) and rhodium (Rh) on top of the inner layer using powder in the size range from 30 to 150 μm, before applying the TBC onto this coating.

In addition, the present invention provides a method of depositing a bond coating to a surface of an article (1), wherein before a Thermal Barrier Coating (TBC) is applied, an inner layer (2) consisting of β-NiAl comprising one or a combination of Fe, Ga, Mo, B, Hf or Zr or γ/β-MCrAlY comprising one or a combination of Fe, Ga, Mo, B, Hf or Zr or γ/γ'- or γ-MCrAlY is deposited on the surface of the article using powder in the size range up to 65 μm and an outer layer (3), which is more coarse than the in the inner layer, consisting β-NiAl comprising one or a combination of Fe, Ga, Mo, B, Hf or Zr or γ/β-MCrAlY comprising one or a combination of Fe, Ga, Mo, B, Hf or Zr or γ/γ'- or γ-MCrAlY is deposited by plasma spraying using powder in the size range from 30 to 150 μm and at least one layer (5) of platinum type metal is applied onto the surface of the article (1), between the inner and the outer layer (2, 3) or on top of the outer layer (2), the platinum type metal material selected from the group consisting of platinum (Pt), palladium (Pd) and rhodium (Rh).

Present approaches to reduce or inhibit formation of transient scale on rough surface include:

a) depositing rough layer using coarse powder of coating composition that have lower tendency of formation of transient scale, i.e. coating having optimized amounts of Cr, Al to promote alumina scale and reactive elements in the composition for scale adhesion, b) a prior heat-treatment to remove the NiO and $Cr_2O_3$ scale formed during initial oxidation. This could be done for example by subjecting the sample to a thermal cycling for a limited number of times ate 1000°-1150° C. and then grit blasting followed by TBC application, and apply Pt layer on the roughened surface followed by a heat-treatment.

In addition to above the other factors known beneficial to adhesion are a) minimize the Coefficient Thermal Expansion (CTE) mismatch and b) use a thinner and ductile bond coat.

The addition of Fe in small quantity to β-NiAl or γ/β-MCrAlY has been found to enhance the coating ductility.

Recent development in coating manufacturing technologies have shown that the electroplated process, can deposit thin MCrAlY coating with the additional advantage that the process has no line of sight limitation and can coat large industrial gas turbine components without any difficulty.

Due to the fact that the outer bond coating layer is deposited using a powder which is more coarse then the underlying inner layer, the surface roughness and the TBC adherence is significantly increased. The coating will comprise one or a combination of Fe, Ga, Mo, B, Hf or Zr for the reason of increased ductility of the bond coating and improved fatigue resistance due to addition of individually or in combination (wt.-%) 0.01-8% Fe, 0.1-8% Ga, 0.1-8% Mo, 0.01-0.5% Zr, 0.05-1% B, preferably 0.01-4% Fe, 0-1% Ga, 0-2% Mo, 0.05-0.3% Zr, 0-0.1% B, 0.1-0.5% Hf or (wt.-%) below 4% Fe+Ga+Mo+B+Zr+Hf, whereby Zr is less than 0.3% and B is less than 0.01%. The platinum type metal in the range of (wt.-%) 0.1-20% Pt, Pd or Rh or the layer of pure platinum is added to promote formulation of pure $Al_2O_3$ with no transient oxides.

Pt can be blended with the dispersed β-NiAl or γ/β-MCrAlY particles, the β-NiAl or γ/β-MCrAlY particles comprising one or a combination of Fe, Ga, Mo, B, Hf or Zr in the structure. Where a γ/γ'- or γ-MCrAlY coating is applied it can be as well blended with dispersed α-NiAl or γ/β-MCrAlY particles, the β-NiAl or γ/β-MCrAlY particles comprising one or a combination of Fe, Ga, Mo, B, Hf or Zr in the structure can be over coated with Pt. The high aluminum β-NiAl or γ/β-MCrAlY particles are to replenish the aluminum lost by oxidation and depletion as a function of time and temperature. The γ/γ'- or γ-MCrAlY coating or the Pt type metal layer will comprise a volume fraction of 0.1-5% β-NiAl or γ/β-MCrAlY particles.

For the formation of $Al_2O_3$ prior to TBC-deposition the deposited bond coating can be heat-treated at temperatures up to 1150° C., which is possible in air, hydrogen, argon, vacuum or an environment conductive to form the alumina scale. Preferentially subsequent to heat-treatment the bond coating system can be thermally cycled to remove any transient that may have been formed during heat-treatment.

An inner layer of MCrAlY class of coatings can be conveniently deposited by electroplated process to provide a relatively thin and uniform coating, whereas when the inner layer is of β-NiAl it can be applied by CVD, gas phase, chemical vapor deposition or pack cementation process.

The outer and coarse layer of MCrAlY or β-NiAl comprising one or a combination of Fe, B, Ga, Mo, Hf or Zr may be deposited on the inner layer of the bond coat by plasma spray in air or vacuum or any other conventional methods used for deposition of overlay and bond coatings.

The layer of a pure platinum type metal can be deposited by plating or any other conventional process used for elemental deposition of platinum on metallic substrate such an electrolytic process.

BRIEF DESCRIPTION OF DRAWINGS

The present invention is discussed in detail below with reference to the accompanying drawings, in which.

DETAILED DESCRIPTION

Figure 1:
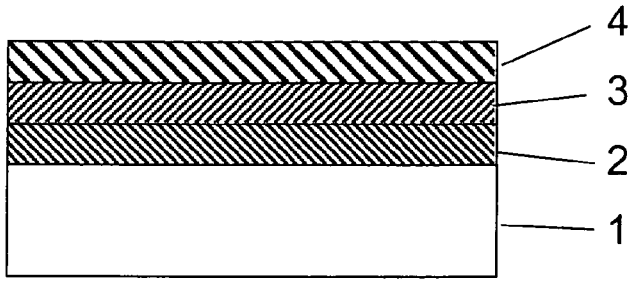
FIG. 1 shows first example for different layers of the bond coating according to the present invention.

FIG. 1 shows a multi-layered bond MCrAlY-coating and a method of depositing the layered bond coating of an article 1. The article 1 such as turbine blades and vanes or other parts of a gas turbine is for the use within a high temperature environment. In many cases they consist of a nickel or cobalt base super alloy such as disclosed, by way of an example, in U.S. Pat. No. 5,759,301. In principle, the article 1 can be single crystal (SX), directionally solidified (DS) or polycrystalline.

According to the invention the MCrAlY bond coating consists of two different layers 2, 3. An inner layer 2 on top of the surface of the article 1 consisting of MCrAlY with a structure of β-NiAl, γ/β-MCrAlY, γ/γ'- or γ-MCrAlY. The coating will comprise a platinum type metal, the platinum type metal material selected from the group consisting of platinum (Pt), palladium (Pd) and rhodium (Rh). The inner layer 2 is deposited with a powder in the size range from 3 to 65 μm i.e. 3 to 20 μm by electroplated process and 20 to 65 μm by plasma spraying. An outer layer 3 on top of the inner layer 2 consists again of β-NiAl, γ/β-MCrAlY or γ/γ'-MCrAlY or γ-MCrAlY comprising a platinum type metal, the platinum type metal material selected from the group consisting of platinum (Pt), palladium (Pd) and rhodium (Rh). But, in contradiction to the inner layer 2, the outer layer 3 is deposited with a powder, which is more coarse than the inner layer 2, in the size range from 30 to 150 μm. The composition and microstructure of the outer layer 3 can also be independently adjusted to allow formation of an alumina scale beneath the TBC.

A ceramic coating such as a Thermal Barrier Coating (TBC), which is zirconia stabilized by yttria, ceria, calcia, scandia or lanthania, is deposited on top of the outer bond coating layer 3. Due to the fact that the outer bond coating layer 3 is deposited using a powder which is coarser then the underlying inner layer, the surface roughness and the TBC adherence is significantly increased.

Figure 2A:
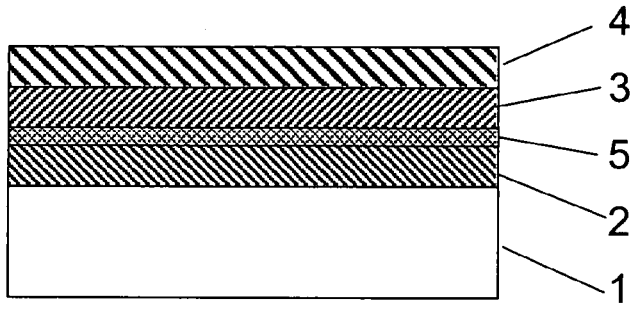
FIGS. 2*a-c* show a second example for different layers of the bond coating according to the present invention.
Figure 2B:
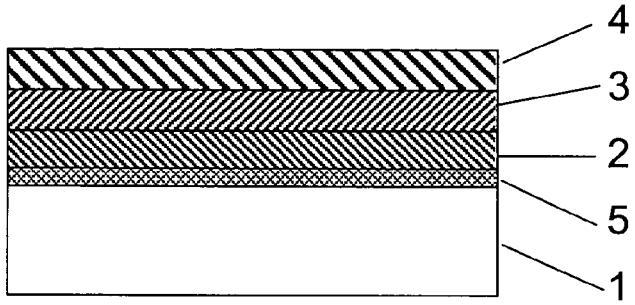
Figure 2C:
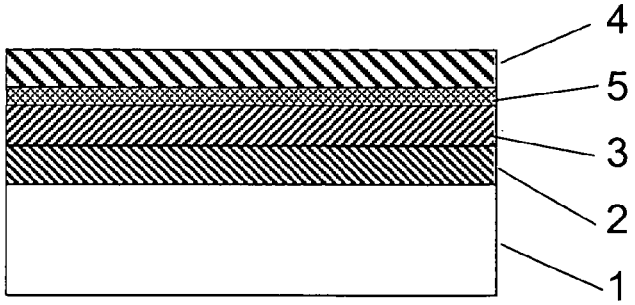

According to FIGS. 2*a-c* another inventive possibility of depositing the coating is to apply an inner layer 2 and an outer layer 3 of β-NiAl, γ/β-MCrAlY, γ/γ'- or γ-MCrAlY without any a platinum type metal in the structure. But, in addition, there will be a layer 5 of a platinum type metal, the platinum type metal material selected from the group consisting of platinum (Pt), palladium (Pd), and rhodium (Rh), the layer 5 of a platinum type metal is deposited onto the surface of the article 1, between the inner and the outer layer 2, 3 or on top of the outer layer 3. In this embodiment will the outer layer 3 of the bond coating be for the reason of better TBC adhesion coarser than the inner layer 2. The layer 5 of a pure platinum type metal is deposited by plating or any other conventional process for elemental deposition of platinum on metallic substrate.

As an example according to FIG. 1 the inner and/or the outer layer 2, 3 of the metal coating comprising alone or in combination (wt.-%) 0.1-20% Pt, Pd or Rh. As an example according to FIGS. 2*a-c* the Pt type metal layer 5 can be blended with dispersed β-NiAl or γ/β-MCrAlY particles, the β-NiAl or γ/β-MCrAlY particles can comprise one or a combination of Fe, Ga, Mo, B, Hf or Zr in the structure.

If a β-NiAl or γ/1-MCrAlY is used as an inner or outer layer 2, 3 it will comprise alone or in combination Fe, Ga, Mo, B, Hf, or Zr for the reason of increased ductility of the bond coating and improved fatigue resistance without reducing the oxidation resistance. As an example the inner and/or the outer layer 2, 3 of β-NiAl or γ/β-MCrAlY coating comprise individually or in combination (wt.-%) 0.01-8%

Fe, 0.1-8% Ga, 0.1-8% Mo, 0.01-0.5% Zr, 0.05-1% B, preferably 0.01-4% Fe, 0-1% Ga, 0-2% Mo, 0.05-0.3% Zr, 0-0.1% B, 0.1-0.5% Hf. As another example the β-NiAl or γ/β-MCrAlY coating will comprise (wt.-%) below 4% Fe+Ga+Mo+B+Zr+Hf, whereby Zr is less than 0.3% and B is less than 0.01%. These figures are as well valid for the above mentioned β-NiAl or γ/β'-MCrAlY particles within the layer 5 of platinum type metal or a γ/γ'- or γ-MCrAlY-coating.

If a γ/γ'- or γ-MCrAlY is used for the inner and/or outer layer 2, 3 it can be blended with disperses β-NiAl or γ/β-MCrAlY particles, the β-NiAl or γ/β-MCrAlY particles comprising one or a combination of Fe, Ga, Mo, B, Hf or Zr in the structure in the range as mentioned above. The high aluminum β-NiAl or γ/β-MCrAlY particles are to replenish the aluminum lost by oxidation and depletion as a function of time and temperature.

The oxidation resistance of the mentioned coating layer 2, 3 are improved by a small addition of Y, Hf, Si, Zr. These elements may added in the range of (wt. %) 0.001-0.5% Y, 0.1-4% Si, 0.01-0.2% Zr.

The overall bonding layer 2, 3 will have a thickness of 50 to 400 micrometers, a preferred range of 50 to 300 micrometers and a most preferred range of 50 to 125 micrometers. The fatigue resistance can be further increased by using thinner coatings. Thereby with the methods mentioned herein an inner layer 2 with a thickness in a range of 50 to 400 micrometers, an outer layer 3 a thickness in a range of 30-120 micrometers, a layer 5 of platinum type metal a thickness in a range of 10-30 micrometers and a layer 6 of aluminum oxide with a thickness in a range of 0.5 to 10 micrometers can be deposited or formed by preoxidation.

EXAMPLES OF COATINGS

A β-NiAl coating may comprise (wt.-%) 20 to 25% Al, a γ/β-MCrAlY coating may comprise (wt.-%) 8 to 17% Al and a γ/γ'- or γ-MCrAlY coating may comprise (wt.-%) 3 to 6% Al.

Table 1 shows some example of contents of coatings (wt.-%)

TABLE 1

| Type | Ni | Co | Cr | Al | Re | Si | Y | Ta | Zr | Fe | Pt |
|---|---|---|---|---|---|---|---|---|---|---|---|
| γ/γ'-MCrAlY | Bal. | — | 24 | 5 | — | 2.5 | 0.5 | 1 | 00.5 | — | 1 |
| γ/γ'- or γ-MCrAlY | Bal. | — | 5-30 | 3-6 | — | — | 0.5 | — | — | — | — |
| γ/β-MCrAlY + Fe | Bal. | 30 | 13 | 12 | — | 1.5 | 0.5 | — | 0.5 | 3 | 1 |
| γ/β-MCrAlY | Bal. | 28-35 | 11-15 | 10-13 | 0-1 | 1-2 | 0.005-0.5 | 0.2-1 | — | — | — |
| β-NiAl | Bal. | — | — | 25 | — | — | — | — | 0.1 | 3 | 1 |
| β-NiAl + Fe | Bal. | — | — | 20-25 | — | — | 0.005-0.5 | — | 0.005-0.2 | 0.1-5 | 1 |
| γ/β-MCrAlY + Fe | Bal. | 23 | 18 | 10 | — | — | 0.5 | — | — | 0.5 | — |
| γ/β-MCrAlY | Bal. | 23 | 18 | 10 | — | — | 0.5 | — | — | — | — |
| β-NiAl | Bal. | — | — | 25 | — | — | — | — | 0-.0.1 | — | — |

Figure 3:
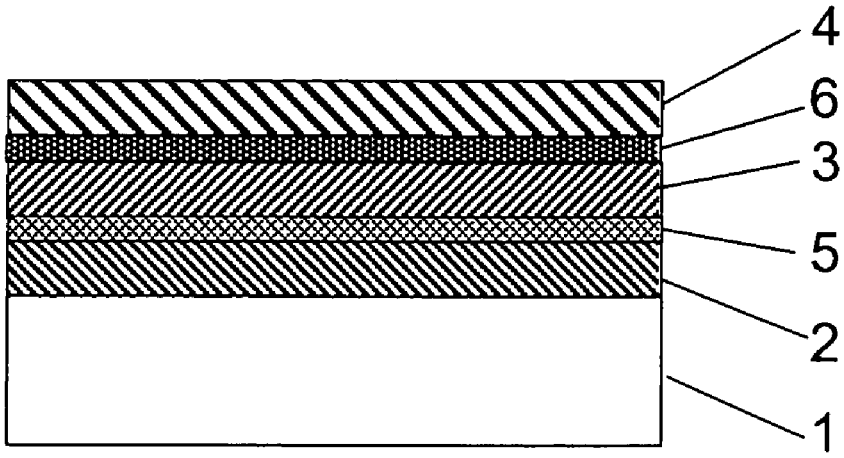
FIG. 3 shows yet another example for different layers of the bond coating according to the present invention.

Optionally, as seen in FIG. 3 for the formation of a layer 6 of $Al_2O_3$ prior to TBC-deposition, the deposited bond coating may be heat-treated at temperatures of up to 1150° C., which can be done in air, argon, vacuum or an environment conductive to form the alumina scale, which further increases the TBC adherence. This can be accomplished during post-coating heat-treatment. The 1150° C. heat-treatment has been found to be most advantageous to fully stabilize the microstructure. To aid in the formation of the aluminum scale the outer layer 3 or a layer 5 of a pure platinum type metal can be pre-oxidized or can also be aluminized using a pack or an out of pack gas phase diffusion process. The aluminizing thickness will be in the range of 10 to 75 micrometers, preferably 10 to 50 micrometers. The aluminum content is in the range from 20 to 24 wt.-%

The layer of a pure platinum type metal can be deposited by plating or any other conventional process for elemental deposition of platinum on metallic substrate.

An inner layer 2 of MCrAlY class of coatings can be conveniently deposited by electroplated process to provide a relatively thin and uniform coating. An inner layer 2 of β-NiAl coating can be applied by CVD, gas phase, chemical vapor deposition or pack cementation process.

The outer and coarse layer 3 of MCrAlY or P-NiAl comprising one or a combination of Fe, B, Ga, Mo, Hf or Zr may be deposited on the inner layer of the bond coat by plasma spray in air or vacuum or any other conventional methods used for deposition of overlay and bond coatings.

The layer of a pure platinum type metal can be deposited by plating or any other conventional process used for elemental deposition of platinum on metallic substrate such an electrolytic process.

What is claimed is:

1. A surface coating on an article, the surface coating comprising:

an inner layer of a first high temperature metallic coating consisting of one of a first β-NiAl, a first γ/β-MCrAlY, a first γ/γ'-MCrAlY, and a first γ-MCrAlY, each including a first noble metal selected from the group consisting of platinum, palladium, and rhodium, an outer layer of a second high temperature metallic coating disposed on top of the inner layer, the second high temperature metallic coating being coarser than the first high temperature metallic coating and consisting of one of a second β-NiAl, a second γ/β-MCrAlY, a second γ/γ'-MCrAlY, and a second γ-MCrAlY, and having a second noble metal selected from the group consisting of platinum, palladium, and rhodium, wherein the first and second β-NiAl and the first and second γ/β-MCrAlY, if present, include at least one element selected from the group consisting of Fe, Ga, Mo, B, Hf, Zr or Ta; and a Thermal Barrier Coating.

2. A surface coating on an article, the surface coating comprising:

an inner layer of a first high temperature metallic coating consisting of one of a first β-NiAl, a first γ/β-MCrAlY, a first γ/γ'-MCrAlY, and a first γ-MCrAlY;

an outer layer of a second high temperature metallic coating disposed exterior to the inner layer, the second high temperature metallic coating being coarser than the first high temperature metallic coating and consisting of one of a second 13-NiAl, a second γ/β-MCrAlY, a second γ/γ'-MCrAlY, and a second γ-MCrAlY, wherein the first and second β-NiAl and the first and second γ/β-MCrAlY, if present, include at least one element selected from the group consisting of Fe, Ga, Mo, B, Hf or Zr; and at least one layer of a noble metal selected from the group consisting of platinum, palladium, and rhodium, wherein the at least one layer of the noble metal is disposed on a surface of the article, between the inner and the outer layer, or on top of the outer layer; and a Thermal Barrier Coating.

3. The surface coating as recited in claim 1, wherein the first and second β-NiAl and the first and second γ/β-MCrAlY, if present, include at least one of:

0.01-8% by weight of Fe;

0.1-8% by weight of Ga;

0.1-8% by weight of Mo;

0.01-0.5% by weight of Zr;

0.05-1% by weight of B;

0.1-0.5% by weight of Hf; and 0.1-2% by weight of Ta.

4. The surface coating as recited in claim 3, wherein the first and second β-NiAl and the first and second γ/β-MCrAlY, if present, include at least one of:

0.01-4% by weight of Fe;

0.1-1% by weight of Ga;

01-2% by weight of Mo;

0.05-0.3% by weight of Zr;

0.05-0.1% by weight of B; and 0.1-0.5% by weight of Hf.

5. The surface coating as recited in claim 1, wherein the first and second β-NiAl and the first and second γ/β-MCrAlY of the inner layer, if present, include less than 4% by weight of the at least one element.

6. The surface coating as recited in claim 5, wherein the first and second β-NiAl and the first and second γ/β3-MCrAlY, if present, include less than 0.3% by weight of Zr and less than 0.0 1% by weight of B.

7. The surface coating as recited in claim 1, wherein at least one of the inner and outer layers includes 0.1-20% by weight of the first or second noble metal.

8. The surface coating as recited in claim 1, wherein the first and second β-NiAl, if present, includes 20 to 25% by weight of Al, the first and second γ/γ-MCrAlY, if present, includes 8 to 17% by weight of Al, and the first and second γ/β' MCrAlY and the first and second γ-MCrAlY, if present, include 3 to 6% by weight of Al.

9. The surface coating as recited in claim 1, wherein the first and second γ/γ' MCrAlY and the first and second γ-MCrAlY, if present, are blended with disperses a dispersion of particles, wherein the particles include at least one of β-NiAl particles and γ/β-MCrAlY particles having at least one element selected from the group consisting of Fe, Ga, Mo, B, Hf and Zr.

10. The surface coating as recited in claim 2, wherein the at least one noble metal layer is blended with a dispersion of particles, wherein the particles include at least one of β-NiAl particles and β/γ-MCrAlY particles having at least one element selected from the group consisting of Fe, Ga, Mo, B, Hf and Zr.

11. The surface coating as recited in claim 10, wherein the particles constitute 0.01-5% by volume of the at least one noble metal layer.

12. The surface coating as recited in claim 10, wherein the particles include less than 4% by weight of the at least one element, whereby Zr, if present is less than 0.3% by weight, and B, if present, is less than 0.01%.

13. The surface coating as recited in claim 1, wherein the article is a gas turbine component made from a nickel- or cobalt-base-super alloy.

14. The surface coating as recited in claim 1, wherein the first and second high temperature metallic coatings have the same composition.

15. The surface coating as recited in claim 2, wherein the first and second high temperature metallic coatings have the same composition.

* * * * *